United States Patent [19]

Lonati

[11] 4,407,145

[45] Oct. 4, 1983

[54] KNITWORK DRAWING DEVICE IN A DOUBLE CYLINDER CIRCULAR KNITTING MACHINE

[75] Inventor: Francesco Lonati, Brescia, Italy

[73] Assignee: Lonati S.p.A., Brescia, Italy

[21] Appl. No.: 923,416

[22] Filed: Jul. 10, 1978

[30] Foreign Application Priority Data

Jul. 14, 1977 [IT] Italy ..... 25773 A/77
Mar. 24, 1978 [IT] Italy ..... 21614 A/78

[51] Int. Cl.[3] ..... D04B 9/10; D04B 15/88; D04B 15/92

[52] U.S. Cl. ..... 66/14; 66/149 R; 66/149 S

[58] Field of Search ..... 66/147, 149 S, 149 R, 66/152, 14

[56] References Cited

U.S. PATENT DOCUMENTS

| | | | |
|---|---|---|---|
| 3,253,429 | 5/1966 | Dodds et al. | 66/149 R |
| 3,277,672 | 10/1966 | Oliver, Jr. | 66/149 R |
| 3,750,426 | 8/1973 | Lonati | 66/149 R |
| 3,797,280 | 3/1974 | Lonati | 66/149 R |
| 4,142,384 | 3/1979 | Wood | 66/149 S |

FOREIGN PATENT DOCUMENTS

| | | | |
|---|---|---|---|
| 2402267 | 11/1974 | Fed. Rep. of Germany | 66/149 S |
| 1412180 | 8/1965 | France | 66/149 S |
| 718780 | 11/1966 | Italy | 66/149 R |
| 1024988 | 4/1966 | United Kingdom | 66/149 R |
| 1175131 | 12/1969 | United Kingdom | 66/149 R |

*Primary Examiner*—Wm. Carter Reynolds
*Attorney, Agent, or Firm*—Guido Modiano; Albert Josif

[57] ABSTRACT

A knitwork drawing device which has a hollow piston rod movable axially through one of the needle cylinders in a double cylinder circular knitting machine, and a knitwork retaining member arranged at the height of the stitch-formation area and rotatable with the needle cylinders. The hollow piston rod is secured to a fluid-operated piston slidable in a cylindrical chamber coaxial with the needle cylinders. Tensioning of the knitwork is effected by leaving the hollow piston rod to rest on the knitwork being knitted, which is held at its initial portion by the retaining member internally of the hollow piston rod and by the needles which continue to knit externally of the hollow piston rod. The whole stroke of the piston and hollow piston rod is thus the half of the whole length of the knitwork and the axial dimension of the knitting machine is considerably reduced.

6 Claims, 19 Drawing Figures

KNITWORK DRAWING DEVICE IN A DOUBLE CYLINDER CIRCULAR KNITTING MACHINE

BACKGROUND OF THE INVENTION

This invention relates to a device for drawing the knitwork in a circular knitting machine of the double cylinder type. More particularly, the invention concerns a device of the fluid-operated type, having a piston with a rod which is movable axially within one of the needle cylinders and includes a knitwork engagement means for keeping the knitwork stretched or under tension while being formed, said means rotating together with the needle cylinders and knitwork.

A device of the same general type is described in the Italian Pat. No. 718,780. According to that Patent, the piston is movable in a cylindrical chamber arranged stationary above the upper needle cylinder of the machine, and the rod passes through the upper cylinder and carries, mounted pivotally to its bottom end, a cup-like element which is provided with downward sloping radial pointed fingers for engagement with the knitwork being knitted.

During the knitwork formation, pressurized fluid is discharged from the cylindrical chamber, and the piston allowed to move downwards under its own weight, thus putting under tension the knitwork being knitted, wherethrough the ends of the cup element fingers are caused to penetrate. On completion of the knit article, the piston is raised by admitting fluid under pressure into the cylindrical chamber to restore the initial conditions.

U.S. Pat. No. 3,750,426 discloses a device of that same general type, with the exception that the piston now carries pivotally several rods, whereto the cup element is rigid. The rods are rotated by the upper needle cylinder itself, such as to relieve the knitwork or fabric of any rotary drag of the cup element.

However, a device to the same design as disclosed in the cited patents requires the provision for a cylindrical chamber of considerable height above the upper needle cylinder, that height dimension being substantially equal to the piston stroke length, i.e. to the length of the knitwork article to be stretched. This results in a considerable increase of the machine overall height.

According to another solution, set forth in the U.S. Pat. No. 3,797,280, it is possible to reduce the height of the cylindrical chamber and the stroke length of the piston by arranging a second piston in a second chamber extending coaxially with the first chamber, the pistons being actuated at different times, thereby while the main or master piston returns upwards, the tensioning action is provided by the second piston, and viceversa.

This approach, additionally to affording a reduction in the machine height, also ensures continuous stretching, but involves a comparatively complex structure for the arrangement of two cylindrical chambers and two pistons, as well as two sets of rods, to be provided each with knitwork engagement means of their own.

SUMMARY OF THE INVENTION

The general object of this invention is to provide a knitwork drawing device, which has a smaller overall height than prior art piston devices, and is of simple and economical construction.

Within the scope of this general object the invention aims to provide a drawing device which even if arranged in the upper needle cylinder and over the upper needle cylinder advantageously allows the fabric to be discharged through the upper needle cylinder, that is in the reversed condition which facilitates the subsequent processing of the fabric like the stitch-closing of the tip in the case of a sock or stocking, thus reducing processing time and costs.

Within the scope of the above general object, the invention sets out to provide a device as indicated, which allows closed tip or closed toe end stockings to be manufactured in accordance with the twist process without tightening yarn.

The problem whereon this invention is based is solved by a knitwork drawing device in a circular knitting machine of the double cylinder type, having a fluid operated piston and including a rod axially displaceable in one of the needle cylinders and provided with knitwork engagement means adapted to put the knitwork under tension during its formation, said means rotating together with the needle cylinders and the knitwork, the device being characterized in that the piston has a hollow rod open at both ends, the rod end next to the knitting or stitch-formation area being configured to contact the knitwork being knitted, and in that at the knitting or stitch-formation area there are provided knitwork retaining means having a cross dimension smaller than the cross dimension of the piston rod cavity and rotating with the knitwork.

In a device of this type, wherein, for example, the hollow rod is movable within the upper needle cylinder of the machine, and the knitwork retaining or holding means is pivotally supported through the lower needle cylinder, knitwork or fabric stretching is obtained by holding, at the knitting area, the initial portion of the knitted fabric and that portion which is being knit on the needles, and by leaving the hollow rod to rest with its lower end on the knitwork or fabric at the middle region of the fabric length already knitted, thus putting the whole fabric under tension as it is being knitted. In this way, the advantage is secured of having the maximum stroke length required of the piston and related rod substantially equal to one half the maximum length of the article to be manufactured, thereby it becomes possible to considerably reduce the machine overall height. The hollow configuration of the piston rod, as well as of the piston itself, advantageously permits the fabric or knitwork to be discharged through the upper cylinder even when the drawing device is itself located in the upper needle cylinder; thus, the fabric can be discharged in a reversed condition, which facilitates any subsequent processing of the article, such as the stitch-closing of the tip or toe end in the case of a stocking article, and decreases manufacturing times and costs.

BRIEF DESCRIPTION OF THE DRAWINGS

Further features and advantages of the invention will become apparent from the following detailed description of some preferred embodiments thereof, given herein by way of example only and illustrated in the accompanying drawings, where.

DESCRIPTION OF THE PREFERRED EMBODIMENTS

Figure 1:
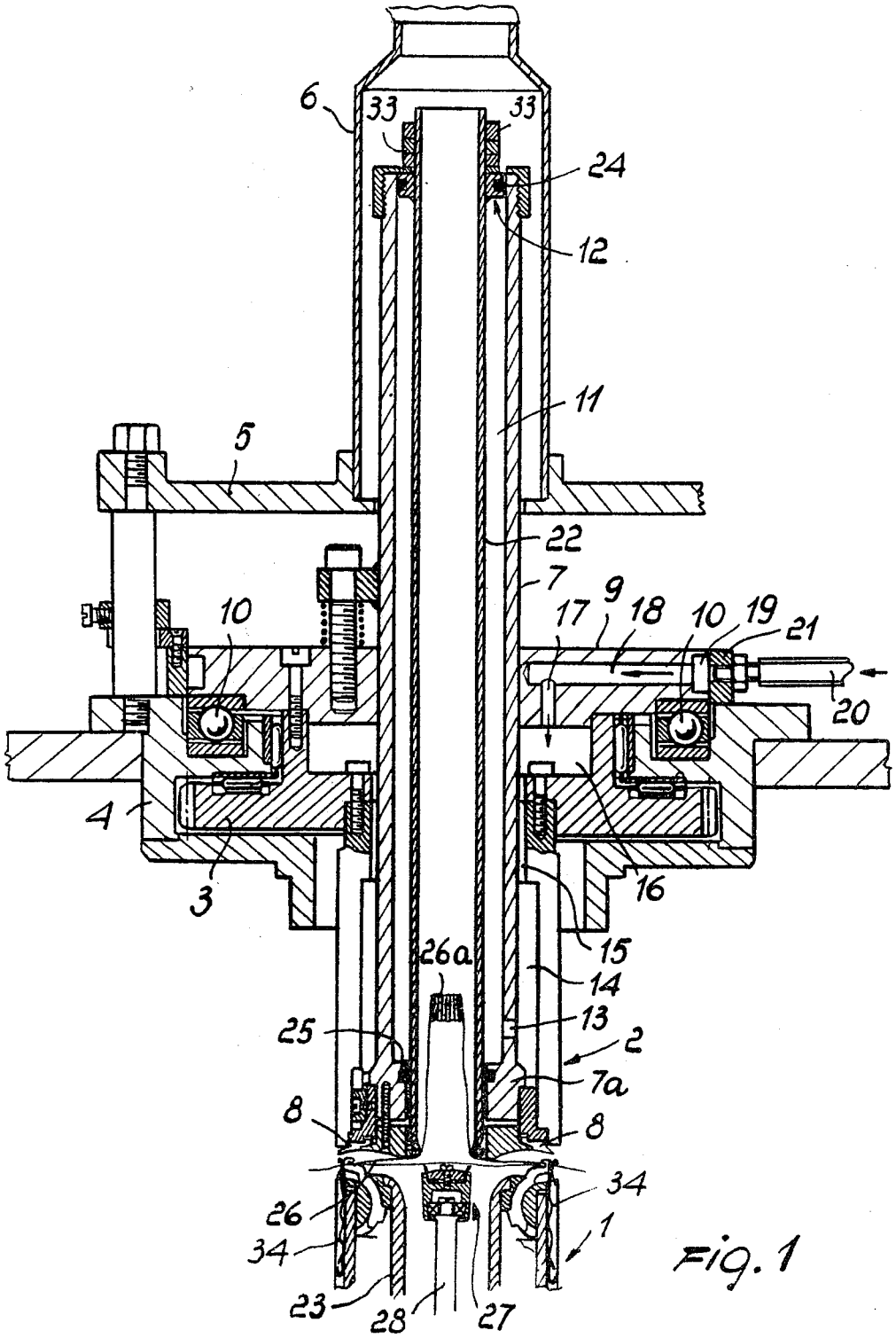
FIG. 1 is an axial sectional view through part of a double-cylinder circular knitting machine incorporating a device according to a first embodiment of the instant invention.
Figure 2:
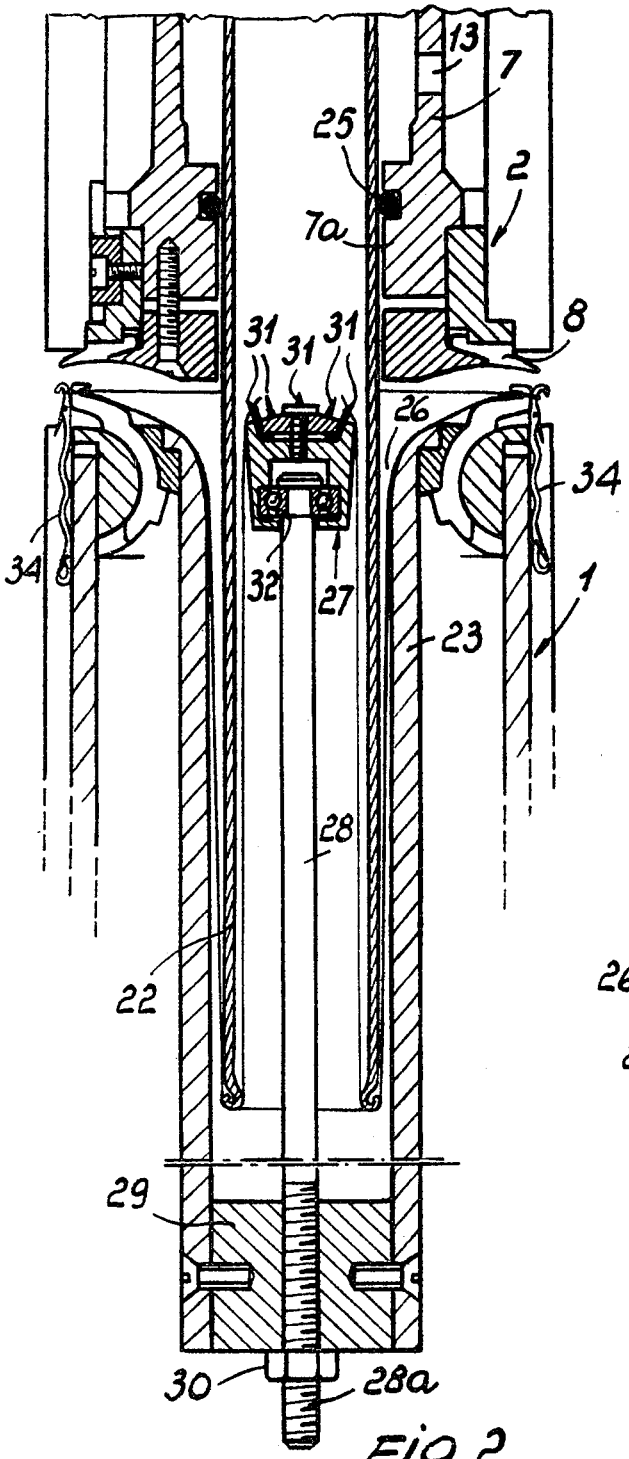
FIG. 2 is a partial axial section of the same machine, on an enlarged scale and during a different knitting step.

Making reference initially to FIGS. 1 and 2 of the drawings, there are indicated at 1 the lower needle cylinder and at 2 the upper needle cylinder of a double cylinder circular knitting machine for stocking articles, the upper cylinder 2 being driven to rotate through a gear 3 actuated by the machine powering means, the lower cylinder 1 being rotated by means not shown. The numeral 4 denotes the stationary portion of the machine, mounting a bracket 5 which carries a tube 6 coaxial with the cylinders 1 and 2 and communicating with a suction duct for discharging the fabric or knitwork. The illustrative machine is configured to discharge the fabric from above, such as to have the article reversed, i.e. ready for the subsequent stitch-closing step.

Inside the upper cylinder 2, there is accommodated coaxially a bushing 7 supporting the fixed sinkers 8, which is carried by a plate 9 rigid with the gear 3 and pivotally supported by the stationary portion 4 of the machine through bearings 10. The inside of the bushing 7 defines a cylindrical chamber 11 wherein a piston 12 is movable, the chamber 11 communicating with a pressurized fluid, preferably air, source. To this purpose, the busing 7 has at its bottom portion one or more radial openings 13, which provide communication between the chamber 11 and an outer chamber 14 defined between the bottom portion of the bushing 7 and the structure of the upper cylinder 2. The chamber 14, in turn, communicates through an interspace 15, with an annular chamber 16 defined between the rotary plate 9 and rotary gear 3, that annular chamber 16 being in communication, through one or more passageways 17 formed in the plate 9, with as many radial passageways 18 of the plate 9, which all open to a common annular manifold or header 19. The latter is in constant communication with one or more fixed ducts 20 arranged on the portion 21 attached to the stationary structure 4 of the machine and connected, through corresponding valves not shown, alternately to a pressurized fluid source, not shown, and a discharge outlet.

A hollow rod 22 is rigid with the piston 12, having both its ends open. The outer cross dimension of the rod 22 is smaller than the inner cross dimension of the guide tube 23 arranged stationary within the lower cylinder 1, thereby the rod 22 is allowed to penetrate the lower cylinder to leave an interspace with respect to the tube 23. At 24 and 25, there are indicated seals providing a tight seal between the piston 12, respectively the hollow rod 22, and the bushing 7, the reduced diameter lower portion 7a whereof forms a guiding member for the rod 22. The provision for seals 24 and 25 ensures frictional rotation of the piston 12 and hollow rod 22 together with the bushing 7 and cylinders 1 and 2.

The bottom end of the rod 22, intended for contact with the fabric 26, is advantageously rounded to prevent damaging the fabric. The rod 22 may also be, advantageously, a lightweight pipe section, whereto the piston 12 may be welded, the piston consisting of an annular disk.

The device further comprises, at the knitting or stitch-formation area, defined between the needle cylinders 1 and 2 means for retaining or holding the fabric portion knitted first. Such means comprise, in the embodiment illustrated in FIGS. 1 and 2, a substantially cylindrical body 27 which extends coaxially with the cylinders 1 and 2 and is supported rotatably by a rod or bar 28, which extends through the lower cylinder 1 and is attached at the bottom to the guide tube 23, e.g. as shown in FIG. 2. In this case, the bar or rod 28 has a threaded bottom portion 28a, which is threaded in a supporting body 29 attached to the guide tube 23 and is secured to the body 29 by means of a nut 30. It thus becomes possible to adjust the height level of the body 27.

The body 27 carries circumferentially distributed pointed fingers 31 which are directed upwards and outwards and adapted to penetrate the initial portion of the fabric, as will be apparent hereinafter. The pivotal connection of the body 27 to the rod or bar 28 is provided by bearings 32. The cross dimension of the body 27 and diameter of the ideal circumference joining the free ends of the fingers 31 are smaller than the inside cross dimension of the rod 22. Advantageously, weights 33 may be secured to the piston 12.

For a description of the operation of the above outlined device, reference will be made in particular to FIGS. 3a–13g in which manufacturing of stocking articles is shown.

Figure 3A:
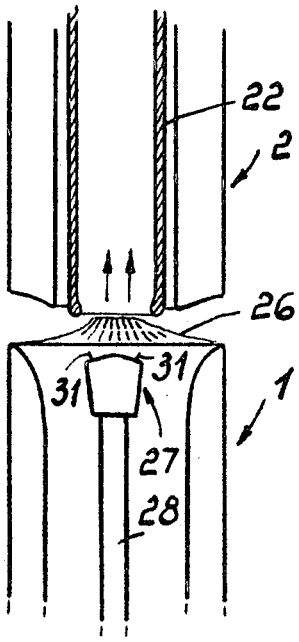
FIGS. 3a,3b,3c,3d,3e,3f and 3g illustrate schematically the operation of the device shown in the preceding figures, as applied to the manufacturing of stockings.
Figure 3B:
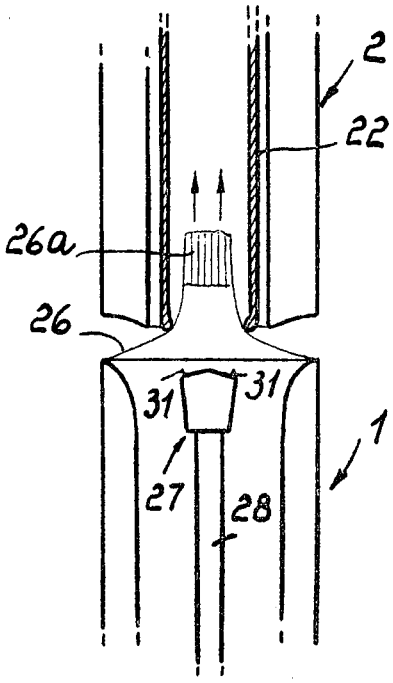
Figure 3C:
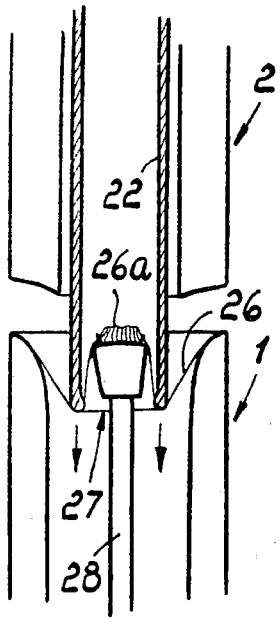
Figure 3D:
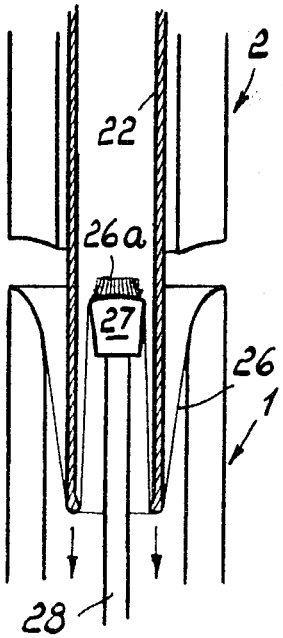
Figure 3E:
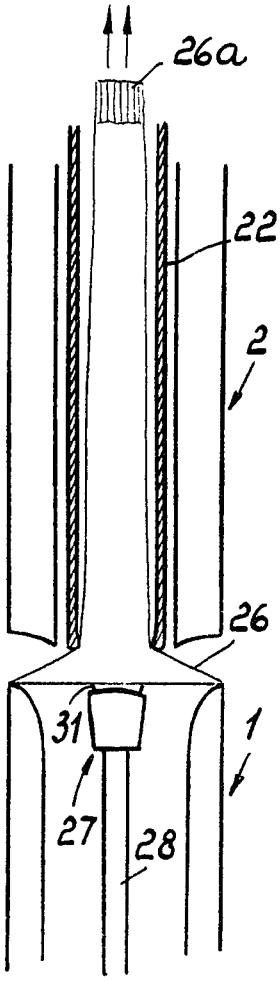

During the first manufacturing step, the piston 12 and rod 22 are at the upper limit of their stroke, as shown in FIG. 1, and are held there by the fluid pressure delivered to the chamber 11. The fabric 26 progressively knitted on the needles 34 is drawn by suction (FIG. 3a) through the hollow rod 22 by sucking means not shown. The knitting process continues thus until a predetermined length is reached, as shown in FIG. 3b. At that point, the fluid pressure in the chamber 11 is released gradually, and the piston 12 and rod 22 move down under their own weight, or the combined effect of their weight and any additional weights 33, the bottom end of the rod 22 contacting the fabric or knitwork 26. The fabric portion knitted initially, namely the edge or border 26a of the stocking article, during the downward movement of the rod 22 is caught in the fingers 31, thanks to the elasticity of this portion which contracts to produce a circumference of smaller diameter than the diametrical distance of the tips of the fingers 31. At this point, there occurs the event shown in FIG. 3c, where the rod 22 bears with its full weight and the weight of the piston 12 on the fabric 26 being retained, on one side, by the fingers 31, and on the other side by the needles 34 which carry on knitting. The suction action is suspended.

As the knitting progresses, the rod 22 is gradually lowered, while keeping the fabric under tension (FIG. 3*d*), and the chamber 11 is evacuated completely. The fabric 26 slides progressively under the rounded end of the rod 22. As may be observed, the stroke length travelled by the rod 22 and piston 12 is approximately one half the length of article knitted.

The knitting is carried further on in a similar manner for the whole leg portion of the stocking article, until the heel is reached; whereat the piston, together with the rod 22, is raised by delivering fluid pressure to the chamber 11. The suction action is then restored, as shown schematically in FIG. 3*e*, and the stocking article is tensioned by suction only.

Figure 3F:
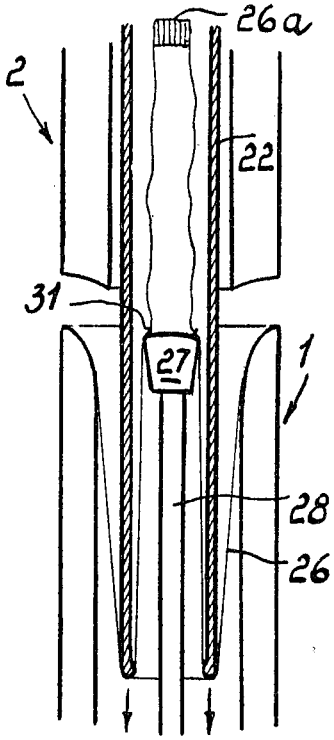

On completion of the heel portion, the fluid pressure in the chamber 11 is gradually released and normal knitting resumed, the stretching being as indicated in FIG. 3*f*. The upward suction is suspended.

Figure 3G:
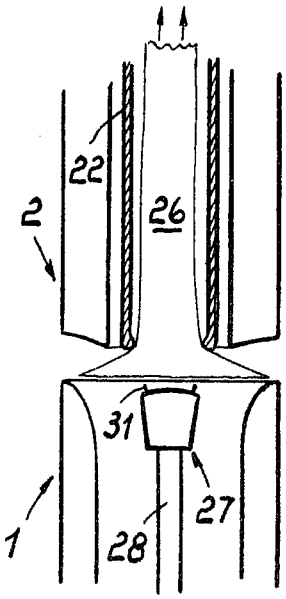

Upon completion of the stocking article (if desired, after finishing the toe end of the stocking article similarly to the knitting of the heel portion proper, as explained above), the upward suction is again activated and the piston 12 and related rod 22 are again raised, as shown in FIG. 3*g*. The stocking article is now discharged from the needles and extracted upwardly by suction into a collecting basket. The stocking article is in its reversed condition, i.e. ready for the subsequent toe end stitching step without involving any intermediate reversing step.

Advantageously, in this embodiment, the cylindrical pressure chamber is to a large extent already defined in the needle cylinder, thereby that portion of the drawing or stretching device which extends beyond the needle cylinder has a substantially smaller length than the piston stroke length, such as to considerably reduce the axial dimension of the machine.

Figure 4:
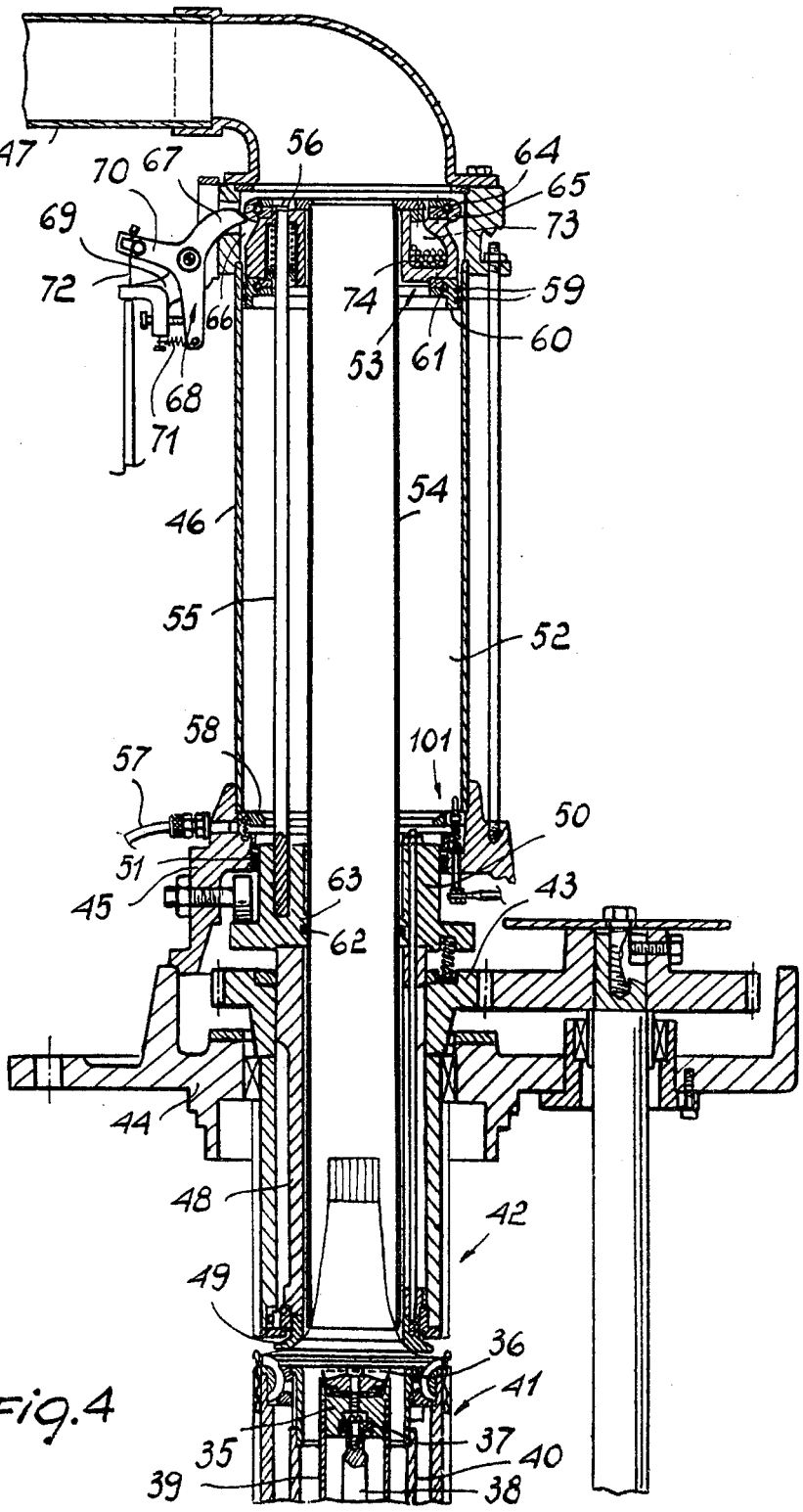
FIG. 4 is an axial section through a machine incorporating a device according to a further embodiment of the invention.
Figure 5:
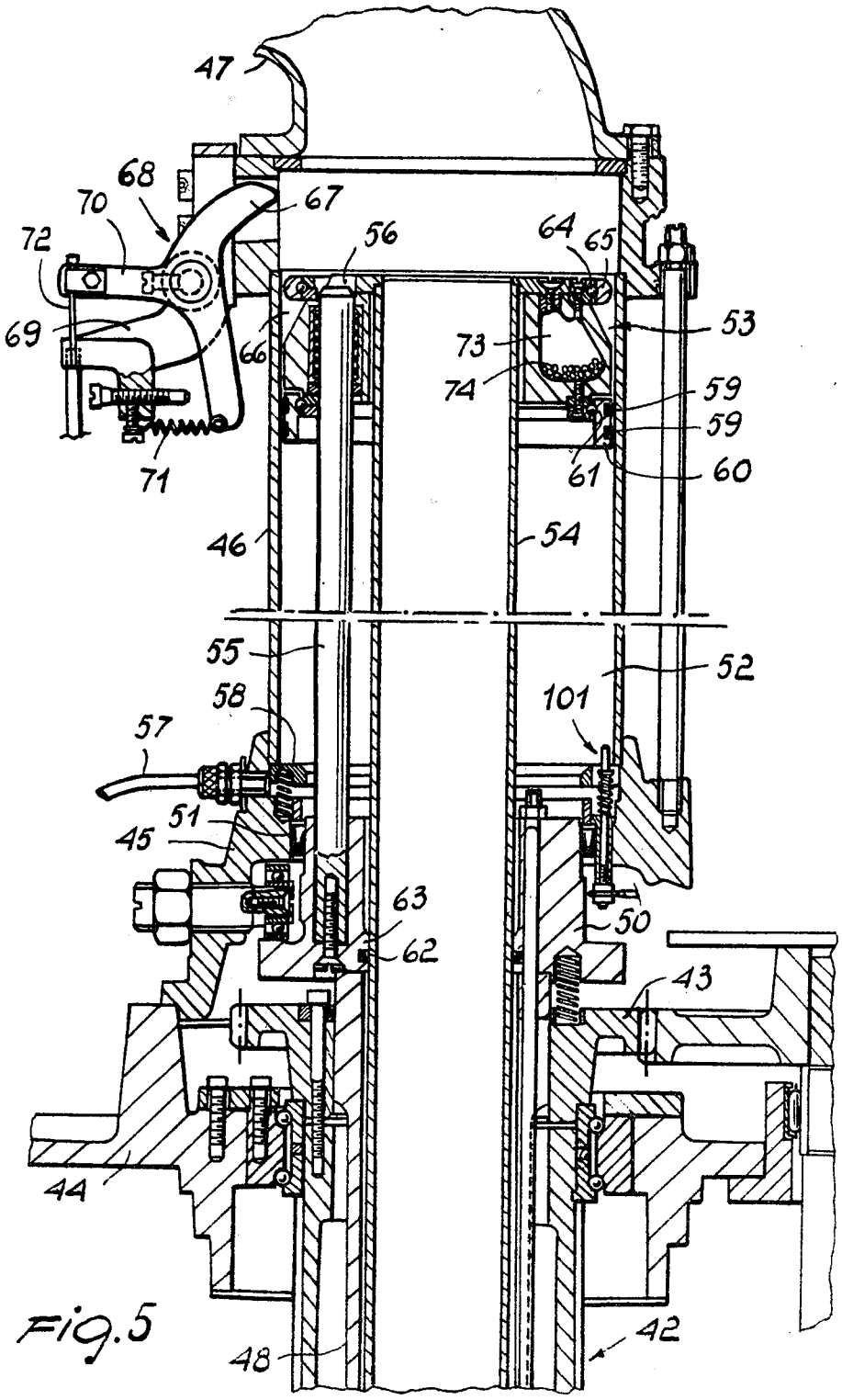
FIG. 5 is an enlarged scale axial sectional view of some portions of the device of FIG. 4, in one operative position thereof.

FIGS. 4 and 5 show an embodiment of the invention wherein the knitwork retaining means comprise a substantially cylindrical body 35 provided with fingers 36 and rotatably supported, through bearings 37, by a rod or bar 38, similarly to the device described with reference to FIGS. 1 and 2. However, a protective tube 39 is attached here to the body 35 which extends through a given length inside the fixed tube 40 associated with the lower needle cylinder 41, said protection tube having the function of preventing the fabric from twisting around the rod or bar 38. The upper needle cylinder is here indicated at 42, and is rotated through a gear 43 driven by the machine powering means. The reference numeral 44 denotes the stationary portion of the machine, which supports rotatably the cylinders 41 and 42 in a manner known per se. The stationary portion 44 mounts fixedly above the cylinder 42 a bell-like support 45, which carries a stationary tube 46 coaxial with the cylinders 41 and 42 and connected to a suction duct 47 for discharging the fabric or knitwork. The diameter of the tube 46 is preferably larger than the cylinders 41 and 42; the length of the tube 46 is substantially equal to one half the length of the fabric to be tensioned.

Within the upper cylinder 42, there is coaxially arranged a bushing 48, which is made rigid with the gear 43 and extends substantially along the entire height of the cylinder 42. The inside diameter of the bushing 48 is smaller than the inside diameter of the tube 46. The bushing 48 carries at the bottom the body 49 supporting the fixed sinkers, whilst the bushing top is rigid with a sleeve member 50 partially penetrating a central cylindrical opening in the support 45; between the top portion of the sleeve 50 and the support 45, there is interposed an annular seal 51.

The inside of the tube 46 defines a cylindrical chamber 52, closed at the bottom by said sleeve member 50, wherein a piston 53 is movable which is provided with a hollow rod 54, this rod extending not only through the cylindrical chamber 52 but also through the entire bushing 48. The rod 54 is open at its ends and also extends through the piston 53. The length of the rod 54 coincides substantially with the combined heights of the bushing 48 plus sleeve member 50 and tube 46; the diametrical dimension of the rod 54 is such as to allow the rod to enter the lower cylinder 41. The end of the cylindrical chamber 52 next to the piston 53 side away from the rod 54 is open and communicates with said duct 47 for sucking and discharging the fabric or knitwork.

At least one upright guiding rod or bar 55 is arranged inside the cylindrical chamber 52, which is attached with one end to the sleeve 50 at an off-centered position with respect to the axis of the chamber 52 and piston 53. The latter has a passage 56 for the rod 55 and is driven to rotate, when the machine is in operation, by the rod itself.

The chamber 52 may be connected alternately to a fluid pressure source and pressure discharge outlet through a duct 57 opening to the bottom portion of the chamber below a stroke end ring 58 for the piston 53, the alternate connection being effected through a valve system, not shown, dependent on the machine program.

The chamber 52, on the piston side, is sealed tight by ring seals 59 mounted on an annular element 60 which is carried rotatably by the piston 53 through bearings 61. In this manner, the ring seals 59 do not rotate with the piston but remain stationary in contact with the fixed tube 46, which improves the life expectancy thereof. On the opposite side, the chamber 52 is sealed, additionally to the seal or gasket 51, by a ring seal 62 attached to an inward restricted portion 63 of the sleeve member 50, which also acts as a guide member for the rod 54.

That portion of the piston 53 facing the suction duct 47 carries rotatably through bearings 64, a peripheral ring 65 such as to define an annular recess 66 wherein one end 67 of a locking lever 68 can be inserted. The locking lever is journaled to a supporting body 69 rigid with the tube 46, and has an actuating arm 70 for shifting the lever 68 from an inoperative position, shown in FIG. 4, whereat the end 67 enters the annular recess 66 and holds the piston 53, to a release position, shown in FIG. 5, whereat the end 67 extends out of the path of the peripheral ring 65, thus releasing the piston 53. A spring 71 tends to hold the lever 68 in its inoperative position. The actuation of the lever 68 between the two positions may be derived, for example, from the machine programming drum through a Bowden cable 72.

The piston 53 may advantageously include one or more recesses 73 adapted for accomodating weights therein, e.g. in the form of small balls 74, in order to adjust the tension force applied on the fabric or knitwork.

The operation of the device shown in FIGS. 4 and 5 is substantially similar to that of the device of FIGS. 1 and 2, thereby it will not be described herein.

Advantageously, with the device of FIGS. 4 and 5, it is not necessary that chamber 52 be held under pressure during the initial knitting step or inoperative step of the assembly to hold the piston 53 raised, as this can be achieved with the locking lever 68 quite conveniently. It thus becomes possible to initiate the drawing or stretching action simply by releasing the piston 53 by means of the lever 68 and allowing the rod 54 to bear on the fabric after the initial knitting step. To avoid such malfunctions as failure of the fingers 31 to retain the initial portion of the knitwork, in which case the rod 54 would drop completely off without getting caught in the knitwork, a microswitch 101 may be provided at the bottom of the chamber 52 which, when actuated by the piston 53, would bring the machine to a full stop through a circuitry known per se.

With the device of FIGS. 4 and 5, the advantage is afforded of simplified construction in that the delivery of fluid pressure need no longer be effected through rotating members, and moreover the bushing height can be reduced and the piston enlarged diametrically, since it is no longer necessary that it be contained within the diametrical limits of the bushing, which must in turn be sized to be contained within the inside limits of the needle cylinder. The guide rod advantageously allows the drawing or stretching assembly to be reliably rotated in synchronization with the knitwork, thus completely relieving the knitwork of dragging the rod.

Figure 6:
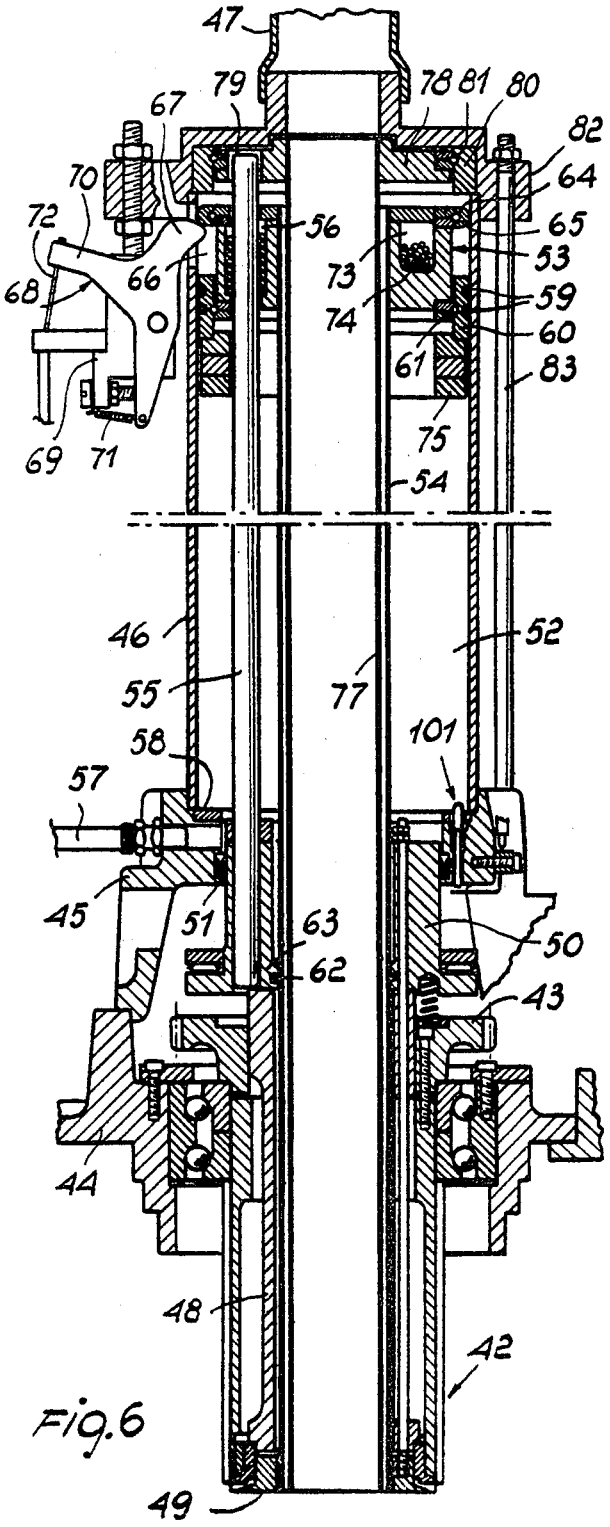
FIG. 6 is an axial section through the upper needle cylinder of a machine incorporating a knitwork drawing device according to another embodiment of this invention.

In order to adjust the tension applied on the fabric or knitwork, it will be appreciated that weights may be provided in the form of disks 75, as shown in FIG. 6, which are supported by the piston itself, e.g. by means of screws 76.

The embodiment of FIGS. 6 to 9 utilizes a majority of the elements of the preceding embodiment, thereby the same reference numerals have been used in FIGS. 6 to 9 for corresponding parts, for the description of which reference can be made to the description provided in relation to FIGS. 4 and 5.

According to the embodiment of FIGS. 6 to 9, there is arranged in the upper needle cylinder 42, coaxially thereto and within the hollow rod 54, a tubular member 77, which is separated from the hollow rod by an interspace and extends from the bottom end of the cylinder 42 to beyond the piston 53. More specifically, as visible in FIG. 6, the tubular member 77 has open ends and is attached to an annular disk 78 having a passageway 79 for the guide rod 55, such that when the machine is in operation, the annular disk 78 and the open-ended tubular member 77 are also rotated about the axis of the cylinders 41 and 42 together therewith. In the embodiment shown, the annular disk 78 is supported by a supporting or carrier ring 80 through bearings 81, the ring 80 being secured to the head 82 of the tube 46 defining the chamber 52, the head 82 being in turn secured to the stationary portion 44 of the machine, for example by means of connecting bars or link rods 83. In this manner, the open-ended tubular member 77 is fixed axially and forms substantially a connective tube between the knitting area and the suction and discharge duct 47, which communicates with the interior of the tubular member 77 at a position away from the stitch-formation area.

The knitwork retaining means at the knitting area comprises, according to the embodiment of FIGS. 6 to 9, the tubular member 77 and a locking member or head 84 coaxial with the tubular member 77 and facing the tubular member at the stich-formation area, said locking member or head 84 having preferably a substantially frustum or truncated cone shape with the minor base located on the side of the knitting area. At its major base, the member 84 has of preference an annular shoulder 85 corresponding to the lower end of the tubular member 77, such as to lay against it. To the widest portion of the member 84, which is anyhow smaller than the inside diameter of the hollow rod 54 and at least equal to the cross extent of the tubular member 77, there is attached of preference a protection tube 86, which extends through a major portion of the lower cylinder 41, i.e. away from the tubular member 77. The member 84 and tube 86 are rotatably carried, through bearings 87, by a supporting bar or rod 88 extending throughout the lower cylinder 41 and ending in a piston 89. The latter is movable in a chamber 90 defined in a cylinder 91, which is made rigid to the fixed guide tube 92 of the lower cylinder 41 by means of a guide and supporting body 93 attached to the guide tube itself. The guide and supporting body 93 is provided with an axial passage 94 wherein the rod 88 is rotatable and axially slidable. In a seat 95, formed in the body 93 on the side next to the cylindrical chamber 90, there is accommodated a coil spring 96, which is active against the piston 89 such as to urge the latter towards the lower portion of the cylindrical chamber 90. The final position is defined by the engagement of a sleeve body 97, attached to the rod 88, with the top or upper end of the guide and supporting body 93. In this position, the locking member 84 has its top end substantially at the plane of the sinker assembly of the lower cylinder 41. Advantageously, the sleeve body 97 may itself act as the support for the tube 86 through bearings 98.

The chamber 90 communicates, on the side away from the lower cylinder 41, through a duct 99 alternately with a fluid pressure source and a discharge outlet, such an alternate connection being effected by means of a valve unit, not shown, which is controlled by the machine operative program.

The operation of the drawing device according to the embodiment of FIGS. 6 to 9 will now be described with particular reference to FIGS. 10*a*–10*d*, illustrating a case of stocking manufacturing.

Figure 10A:
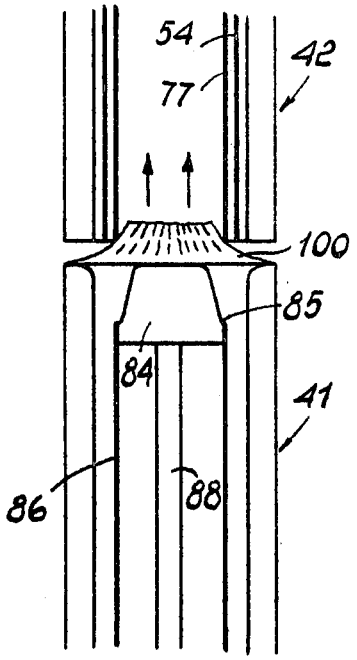
FIGS. 10a, 10b, 10c and 10d show some subsequent steps of the operation of the drawing device of FIGS. 6 to 9.
Figure 10B:
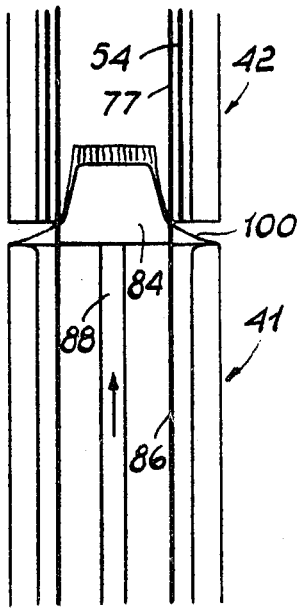
Figure 7:
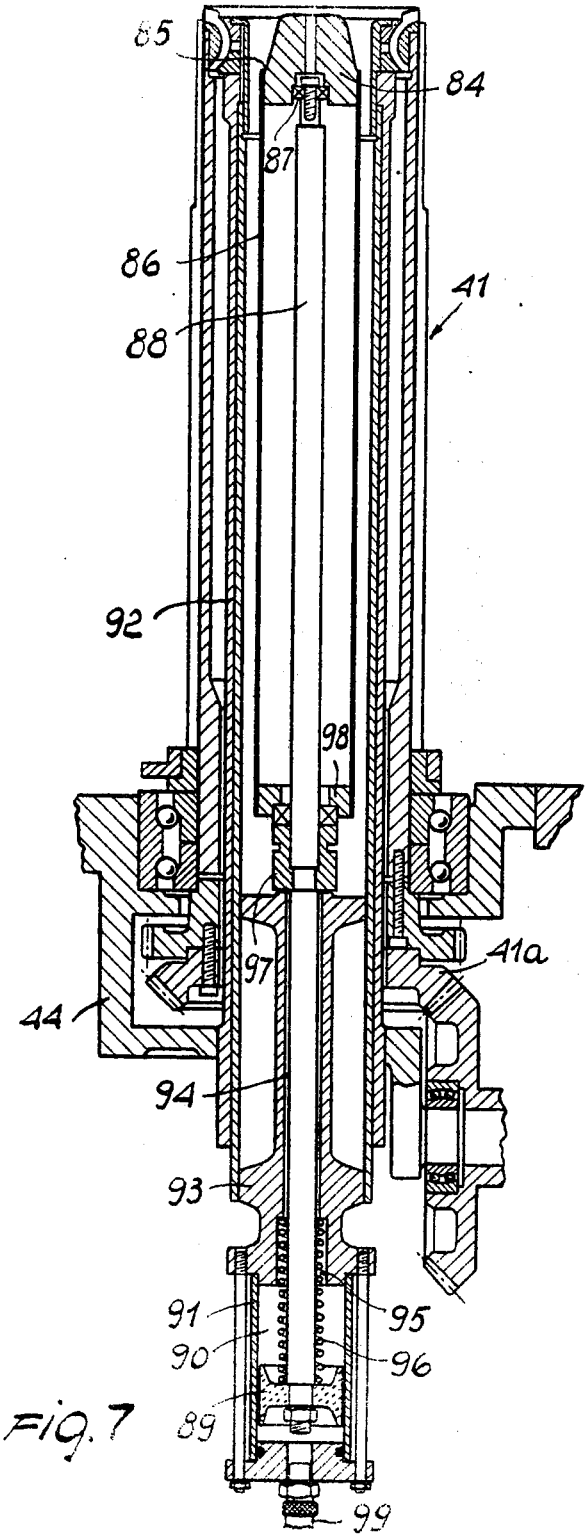
FIG. 7 shows an axial section through the lower needle cylinder of the machine of FIG. 6.
Figure 10C:
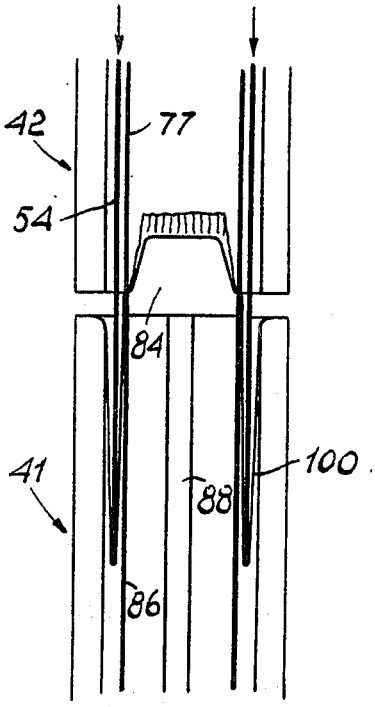
Figure 8:
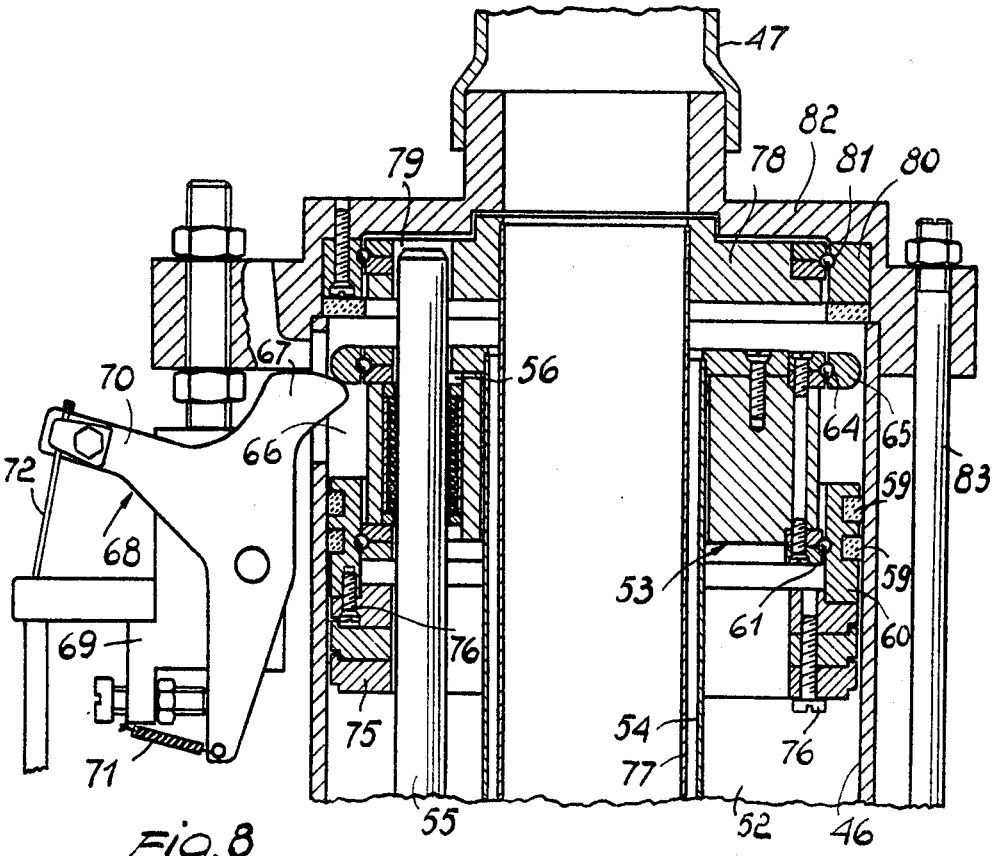
FIG. 8 is an enlarged scale view of the top portion of the machine of FIG. 6.
Figure 9:
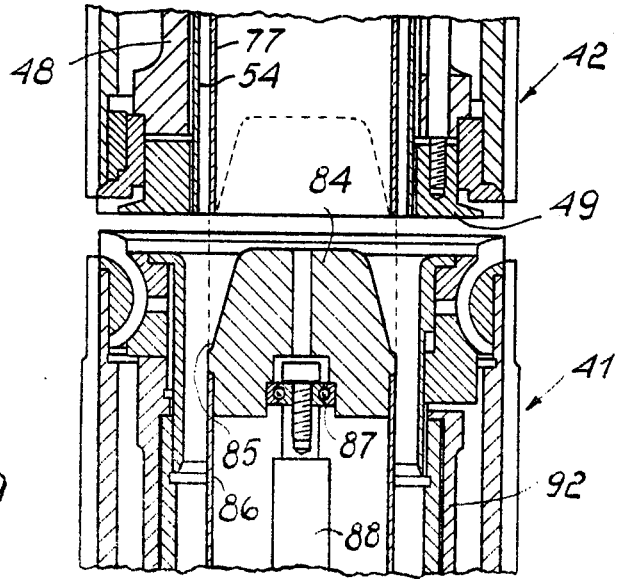
FIG. 9 is an enlarged scale view of the knitting or stitch-formation area in the machine shown in FIGS. 6 and 7.

At the start of the knitting process, the various parts are in the position shown in FIGS. 6, 7 and 8, and shown schematically in FIG. 10*a*. The piston 53 is held raised by the fluid pressure in the chamber 52 as well as by the lever 68. The fluid is delivered to chamber 52 through duct 57 by means of a valve 57*a* from a pressure fluid supply 57*b* (FIG. 6). The knitwork 100 is sucked upwards as it is knitted, the suction system being operative through the duct 47, and enters the tubular member 77 progressively. After a sufficient knitwork length is completed, fluid pressure is delivered to the cylindrical chamber 90 through the duct 99, thus raising the piston 89 and simultaneously raising the locking member 84 until the annular shoulder 85 thereof engages the lower edge of the tubular member 77, thus locking the knitwork or fabric between the members 84 and 77 and within the tubular member 77 (FIG. 10*b*). The locking member 84 now rotates with the fabric. At this stage, while maintaining under pressure the chamber 90 under the piston 89, the suction through the duct 47 may be suspended, and the piston 53 is released through the lever 68. Thereafter the fluid pressure is progressively released from the chamber 52 by means of valve 57*a* connecting duct 57 with discharge duct 57*c* (FIG. 6). The piston 53 is gradually lowered and, together therewith, the hollow rod 54. The bottom portion of the hollow rod 54 then contacts the fabric and moves past the stitch-formation area, thus pulling the fabric downwards as it is being knitted, the fabric being at all times held on one side between the tubular member 77 and locking head 84, and on the other side by the needles knitting it (FIG. 10*c*). The tensioning is effected through the action due to the combined weights of the piston 53 and rod 54 and related components carried thereby, while the chamber 52 under the piston 53 is fully evacuated.

It will be apparent that, as the fabric is being knitted, the piston 53 and hollow rod 54 are lowered, even in this embodiment of the invention, by a distance which is substantially equal to one half the fabric length increment, thereby a piston stroke length substantially equal to one half the fabric total length will be sufficient.

During the knitting of the heel portion of the stocking article, the piston 53 is drawn upwards by supplying fluid pressure to the chamber 52 under the piston. The head 84 is also separated from the tubular member 77. Advantageously, suction through the duct 47 is restored during the whole knitting of the heel to tension the fabric, as already described with respect to the previously described embodiments of FIGS. 1 to 5.

Figure 10D:
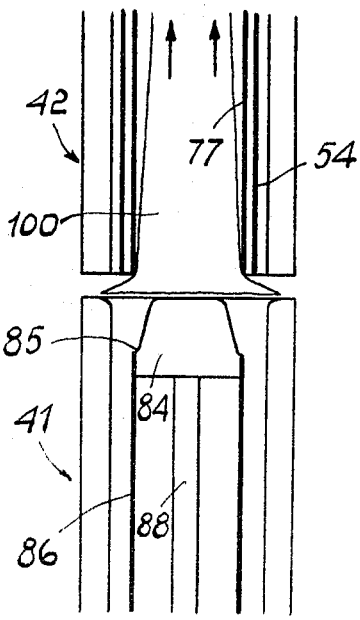

Upon completion of the article knitting process, fluid pressure is first delivered to the chamber 52 under the piston 53, such as to bring the latter to its raised inoperative position as shown in FIG. 6, thereafter the pressure fluid is discharged from the chamber 90, such that the head 84 separates from the tubular member 77 and the article is released (FIG. 10*d*). The knitted article, after being released from the needles, is then sucked by aspiration through the duct 47 and accordingly delivered in the reversed or inverted condition.

The microswitch 101, actuated by the piston 53, is enabled to automatically control, through conventional circuits, the raising of the piston 53 and resuming of the knitting operation in the event of a specially long article relative to the machine axial dimension. A similar microswitch may be provided at the top area of the chamber 52.

It will appear how with the device of FIGS. 6 to 9 the gripping of the initial portion of the fabric 100 is in any case ensured by the fabric being necessarily drawn by suction or aspiration into the tubular member 77 and then locked by the head 84 against it prior to the starting of the axial movement of the hollow rod for the tensioning proper. Furthermore, the fabric is suitably handled without any danger of tearing it. It will also appear that owing to the suction through the open-ended tubular member 77 the fabric entering the tubular member 77 can be clamped at different positions of its length, specifically near the heel portion, thus reducing the whole stroke of the hollow rod 54 to less than half the fabric length.

It will be apparent from the foregoing that with the device according to this invention, in all of the embodiments described hereinabove, not only an overall stroke length is obtained which is approximately equal to one half the article length, but the article is discharged in a reversed condition, the entire result being obtained with extremely simple means which are easily implemented and reliable in operation.

The instance has been described of a device having its movable rod located for the major part in the upper needle cylinder, but it will be understood that the device may also be arranged upside down, i.e. with the hollow rod accomodated normally in the lower needle cylinder and the rod supporting the retaining or holding means located in the upper needle cylinder. During operation, the fluid pressure will then be delivered under control during the drawing or stretching step and released when the heel is to be worked or the stocking article discharged.

The device described in the foregoing also lends itself to the closing of the stocking article toe and by twisting, without tightening yarn; in fact, at the toe end closing step, the hollow rod is fully retracted and the fabric disengaged from the retaining means, thereby it is possible to effect the relative rotation of the two needle cylinders. Understandably, it is also possible to produce panty hose of considerable length, by returning the rod every time it reaches its stroke end limit.

The invention as described herein is susceptible to many modifications and variations, in addition to the ones indicated. Thus, for example, instead of sucking up the fabric during the initial step and the heel knitting step, it would be obviously possible to blow air onto the fabric through the opposite needle cylinder. Several rods could be provided instead of the single guide rod 55. The locking member 84 could be held axially stationary and the tubular member 77 moved axially to engage with the locking member 84.

In a variation of this invention, the locking head 84 could also be without the annular shoulder 85 and engage the tubular member 77 directly with its lateral surface. The tube 86 could obviously be omitted, since it performs a function of fabric or knitwork guiding to prevent the latter, when not under tension, from wrapping itself around the rod 88. Naturally, the tubular member 77 could also be stationary and carry a rotatable lower part. The locking body 84 could be of cylindrical shape and lock the fabric against the end of the tubular member 77 with one of its base ends, or possibly through an annular shoulder corresponding to the annular shoulder 85. Moreover, it would be possible to associate to the upper needle cylinder 2 of FIGS. 1 and 2 the tubular member 77 described with reference to FIGS. 6 to 9, and replace the body 27 of FIGS. 1 and 2 with the locking member 84 of FIGS. 6 to 9.

I claim:

1. In a circular knitting machine having an upper and a lower needle cylinder defining a stitch-formation area therebetween, and needles in said upper and lower needle cylinder, a knitwork drawing device comprising a cylindrical chamber coaxial with said upper and lower needle cylinder, a fluid-operated piston slidable within said cylindrical chamber, a hollow rod secured to said piston and extending at least partially within one of said needle cylinders, said rod having open ends, knitwork retaining means arranged at said stitch-formation area, said knitwork retaining means having a cross dimension smaller than said hollow piston rod and being rotatable with the knitwork, means for delivering pressure fluid into said cylindrical chamber to operate said piston and for discharging pressure fluid therefrom, wherein said knitwork retaining means comprise a tubular member arranged inside said hollow rod and spaced therefrom and a locking member coaxial with said hollow rod and said tubular member, one of said members being axially movable with respect to the other to lock the knitwork therebetween, and wherein said hollow rod is movable past said stitch-formation area to engage and tension the knitwork which is being knitted by said needles and locked by said locking member and said tubular member, and further comprising a fixed tube coaxial with said upper and lower needle cylinder and defining said cylindrical chamber, a suction duct communicating with the interior of said tubular member at a position away from said stitch-formation area, at least one guide rod for said piston arranged within said tube and extending through said piston at an offcentered position, said guide rod being rotatable with said needle cylinders.

2. A device according to claim 1, further comprising a bushing mounted rigidly for rotation with said needle cylinders, a sleeve member between said bushing and said fixed tube, said sleeve member being rotatable with said bushing, a stationary support for said fixed tube, rotatably supporting said sleeve member, said guide rod being rigid with said sleeve member.

3. A device according to claim 1, further comprising an annular member rotatably carried by said piston and seal rings on said tubular member.

4. A device according to claim 1, further comprising a peripheral ring rotatably carried by said piston on a side thereof next to said suction duct, said peripheral ring defining an annular recess on said piston, and a locking lever movable into said annular recess for holding said piston and said rod in an inoperative position wherein the knitwork is not placed under tension.

5. A device according to claim 1, wherein said fixed tube and said piston are arranged above said upper needle cylinder and said piston has at least one inner cavity adapted to accommodate weights, preferably in the form of balls.

6. In a circular knitting machine having an upper and a lower needle cylinder defining a stitch-formation area therebetween, and needles in said upper and lower needle cylinder, a knitwork drawing device comprising a cylindrical chamber coaxial with said upper and lower needle cylinder, a fluid-operated piston slidable within said cylindrical chamber, a hollow rod secured to said piston and extending at least partially within one of said needle cylinders, said rod having open ends, knitwork retaining means arranged at said stitch-formation area, said knitwork retaining means having a cross dimension smaller than said hollow piston rod and being rotatable with the knitwork, means for delivering pressure fluid into said cylindrical chamber to operate said piston and for discharging pressure fluid therefrom, wherein said knitwork retaining means comprise a tubular member arranged inside said hollow rod and spaced therefrom and a locking member coaxial with said hollow rod and said tubular member, one of said members being axially movable with respect to the other to lock the knitwork therebetween, and wherein said hollow rod is movable past said stitch-formation area to engage and tension the knitwork which is being knitted by said needles and locked by said locking member and said tubular member, wherein said tubular member is axially stationary and rotatably supported by a machine stationary portion.

* * * * *